US010724222B2

(12) United States Patent
Shiohara et al.

(10) Patent No.: US 10,724,222 B2
(45) Date of Patent: Jul. 28, 2020

(54) FLUSH TOILET

(71) Applicant: TOTO LTD., Kitakyushu-shi, Fukuoka (JP)

(72) Inventors: Eiji Shiohara, Kitakyushu (JP); Satoshi Takano, Kitakyushu (JP); Hideyuki Nakatsu, Kitakyushu (JP); Yuki Kubota, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/360,741

(22) Filed: Mar. 21, 2019

(65) Prior Publication Data

US 2019/0301151 A1 Oct. 3, 2019

(30) Foreign Application Priority Data

Mar. 27, 2018 (JP) ..... 2018-060551

(51) Int. Cl.
*E03D 11/08* (2006.01)
*E03D 11/02* (2006.01)

(52) U.S. Cl.
CPC ..... *E03D 11/02* (2013.01); *E03D 2201/40* (2013.01)

(58) Field of Classification Search
CPC ..... E03D 11/08; E03D 11/13; E03D 11/18; E03D 11/02
See application file for complete search history.

(56) References Cited

U.S. PATENT DOCUMENTS

2006/0005310 A1* 1/2006 Nakamura ..... E03D 11/08 4/420
2012/0284911 A1* 11/2012 Kamiya ..... E03D 11/08 4/420
2013/0047326 A1* 2/2013 Yamasaki ..... E03D 11/08 4/345
2013/0047329 A1* 2/2013 Yamasaki ..... E03D 11/02 4/420

(Continued)

FOREIGN PATENT DOCUMENTS

JP 2013-044177 A 3/2013
JP 2013044180 A 3/2013

(Continued)

OTHER PUBLICATIONS

An Office Action mailed by the Japanese Patent Office dated Aug. 19, 2019, which corresponds to Japanese Patent Application No. 2018-060551 and is related to U.S. Appl. No. 16/360,741; with partial English translation.

*Primary Examiner* — Janie M Loeppke
(74) *Attorney, Agent, or Firm* — Studebaker & Brackett PC

(57) ABSTRACT

A water passage in a front region of a bowl of a toilet includes an upstream side water passage and a downstream side water passage formed on the upstream side and on the downstream side, respectively, of a front end of the bowl surface. The curvature radius of the downstream side water passage in a plan view is set to be smaller than the curvature radius of the upstream side water passage in a plan view. The water passage in the front region of the bowl has a flow path vertical cross-section that is taken in the vertical direction and is formed between a shelf surface and an overhanging part. The cross-sectional area of the flow path vertical cross-section taken in the vertical direction is set to be the smallest in a front end of the water passage.

7 Claims, 9 Drawing Sheets

(56) References Cited

U.S. PATENT DOCUMENTS

| | | | | |
|---|---|---|---|---|
| 2015/0152628 | A1* | 6/2015 | Hirai | E03D 11/08 4/420 |
| 2015/0267388 | A1* | 9/2015 | Bhardwaj | E03D 11/08 4/425 |
| 2016/0002903 | A1* | 1/2016 | Grover | E03D 11/08 4/405 |
| 2016/0312457 | A1* | 10/2016 | Matsunaga | E03D 11/13 |
| 2017/0183855 | A1* | 6/2017 | Pearson | E03D 11/02 |
| 2017/0198467 | A1* | 7/2017 | Cummings | E03D 11/08 |
| 2017/0260731 | A1* | 9/2017 | Kashirajima | E03D 9/08 |
| 2018/0282989 | A1* | 10/2018 | Kondo | E03D 11/08 |

FOREIGN PATENT DOCUMENTS

| | | | |
|---|---|---|---|
| JP | 2015-169004 | A | 9/2015 |
| JP | 2016176282 | A | 10/2016 |
| JP | 2017160670 | A | 9/2017 |

* cited by examiner

FLUSH TOILET

BACKGROUND OF THE INVENTION

Field of the Invention

The present invention is related to a flush toilet and especially to a flush toilet configured to discharge waste by flushing the flush toilet with flush water supplied from a flush water source.

Description of the Related Art

As conventional flush toilets configured to discharge waste by flushing the flush toilet with flush water supplied from a flush water source, known examples are described in, for example, Patent Document 1 (Japanese Patent Unexamined Publication No. 2015-169004) and Patent Document 2 (Japanese Patent Unexamined Publication No. 2013-44177).

First, a conventional flush toilet described in Patent Document 1 cited above includes a first rim spout port provided in a rim positioned in a lateral region on one side in terms of the left-and-the right direction of the bowl and a second rim spout port provided in the rim positioned in a rear region of the bowl, so that the bowl surface is flushed clean and waste is discharged of only by the flush water (rim spouted water) spouted from these two rim spout ports.

Further, in the conventional flush toilet described in Patent Document 1 cited above, the flush water spouted from the first rim spout port and from the second rim spout port onto the front of the bowl in terms of the circumferential direction whirls along the inner circumferential surface of the rim and subsequently flows downward over the bowl surface toward a recessed part formed underneath.

In that situation, the flush water spouted from the first rim spout port to the front, in particular, passes through the vicinity of the front end of the bowl and subsequently flows vigorously from the front region of the bowl toward the entrance of a draining passage connected to the recessed part underneath the bowl surface positioned in the rear. This configuration improves the level of performance in discharging waste.

As for a basic shape of bowls of conventional commonly-used flush toilets, bowls each have an egg shape or an oval shape that is elongated substantially in the front-and-rear direction, in a plan view. Some bowls are formed in such a manner that the curvature radius of the rim in a plan view is relatively small in a front end of the bowl, as compared with the curvature radii in the entire circumference of the rim of the bowl.

This configuration has a problem where, with regard to the flush water whirling along the inner circumferential surface of the rim in the front end of the bowl, when the water current in the whirling direction is strong, there is a possibility that the flush water may splash to the outside of the bowl or may spatter in the surroundings.

Further, in a conventional flush toilet described in Patent Document 2 cited above, a rim spout port is provided in the vicinity of a front end of the bowl, so that flush water that has just been spouted from the rim spout port vigorously passes through the front end of the bowl.

For this reason, in the conventional flush toilet described in Patent Document 2 cited above, the rim in the front end of the bowl is shaped so that the upper part thereof is overhanging significantly. In this manner, the flush water passing through the front end of the bowl is prevented from splashing to the outside of the bowl and from spattering in the surroundings.

However, when the bowl is shaped so that the upper part of the rim in the front end is significantly overhanging like in the conventional flush toilet described in Patent Document 2 cited above, although it is possible to prevent, without fail, the flush water from splashing to the outside of the bowl and from spattering in the surroundings, it also means that the flush water flows downward over the bowl surface while the strength of the water current is reduced by the overhanging inner wall of the rim.

Accordingly, when the flush water flows downward over the bowl surface while the strength of the water current is reduced in this manner before flowing into the draining passage, a problem is observed where the level of performance in flushing the toilet clean is low, because it is not possible to sufficiently flush waste off the bowl surface, and some uncleaned areas remain on the bowl surface.

Further, another problem is also observed where the level of performance in discharging waste is low because it is not possible to sufficiently discharge the waste through the draining passage.

Accordingly, it has conventionally been a problem that needs to be addressed how to improve the level of performance in flushing the toilet clean and in discharging waste, while effectively preventing the flush water from splashing to the outside of the bowl and from spattering in the surroundings.

SUMMARY OF THE INVENTION

In view of the circumstances described above, the present invention has been made to solve the problems of the related art described above. It is an object of the present invention to provide a flush toilet that is able to effectively prevent the flush water from splashing to the outside of the bowl and from spattering in the surroundings, as well as to improve the level of performance in flushing the toilet clean and in discharging waste.

To solve the problems presented above, the present invention provides a flush toilet configured to discharge waste by flushing the flush toilet with flush water supplied from a flush water source, including: a bowl forming a bowl-shaped surface and including a rim formed on an upper edge of the bowl; a waste receiving surface, and a water passage formed between the waste receiving surface and an inner circumferential surface of the rim; a discharge path which is connected to a lower position of the bowl and is configured to discharge waste in the bowl; and a first rim spout and a second rim spout that are provided in the rim and that form a whirl flow on the bowl surface by spouting the flush water into the water passage, wherein the first rim spout includes a first rim spout port provided at a front of a lateral region of the rim positioned on one side with respect to a central axis line of the bowl surface extending in a front-and-rear direction, the first rim spout port being configured to form a water flow moving toward a front end of the bowl surface by spouting the flush water into the water passage positioned to a front of the bowl, the second rim spout includes a second rim spout port provided in the rim positioned on another side with respect to the central axis line of the bowl surface extending in the front-and-rear direction, the bowl includes a front region including the first rim spout port and the bowl surface formed to a front of the first rim spout port, the water passage provided in the front region of the bowl includes an upstream side water passage and a downstream side water passage that are respectively formed on an upstream side and a downstream side of the front end of the bowl surface, respectively, a curvature radius of the downstream side water passage in a plan view being set to be smaller than a curvature radius of the upstream side water passage in a plan view, the rim provided in the front region of the bowl includes an overhanging part formed in such a manner that an upper section of the inner circumferential surface of the rim protrudes toward an inside of the bowl, and the water passage provided in the front region of the bowl has a shelf surface onto which the flush water is spouted from the first rim spout port and a flow path vertical cross-section which is formed between the shelf surface and the overhanging part so that an upper of the flow path vertical cross-section is covered by the overhanging part, a cross-sectional area of the flow path vertical cross-section being set to be smallest in a front end of the water passage.

According to the present invention described above, in the front region of the bowl, the flush water spouted from the first rim spout port into the upstream side water passage passes through the front end of the bowl surface and subsequently whirls into the downstream side water passage.

In that situation, with regard to the water passage in the front region of the bowl, the flow path vertical cross-section taken in the vertical section which is formed between the shelf surface and the overhanging part and which has the section positioned thereabove covered by the overhanging part is configured in such a manner that the cross-sectional area thereof is set to be the smallest in the front end of the water passage.

With this arrangement, it is possible to also set the overhanging amount (the protruding amount) of the overhanging part in the front end of the water passage provided in the front region of the bowl to be relatively small.

In contrast, it is possible to set the overhanging amount (the protruding amount) of each of the overhanging parts of the upstream side water passage and the downstream side water passage provided in the front region of the bowl to be larger than the overhanging amount (the protruding amount) in the front end of the water passage.

As a result, when the flush water spouted from the first rim spout port onto the upstream side water passage passes through the front end of the water passage, it is possible to prevent the flush water from losing energy due to a collision against the overhanging part. It is therefore possible to cause the flush water to whirl into the downstream side water passage while maintaining a high energy level.

Further, when the flush water that has passed through the front end of the water passage provided in the front region of the bowl flows through the downstream side water passage, energy loss easily occurs, because the curvature radius of the downstream side water passage in a plan view is set to be smaller than the curvature radius of the upstream side water passage in a plan view, while the overhanging amount (the protruding amount) of the overhanging part observed on the flow path vertical cross-section of the downstream side water passage is larger than that in the front end of the water passage.

Accordingly, as for the flush water in the downstream side water passage, it is possible to cause, without fail, the flush water to flow downward from the front to the waste receiving surface and to prevent the flush water from splashing by providing the overhanging part of the downstream side water passage.

Further, because it is also possible to set the overhanging amount (the protruding amount) of the overhanging part of the upstream side water passage provided in the front region of the bowl to be larger than the overhanging amount (the protruding amount) in the front end of the water passage, it is possible to prevent the flush water from splashing, which could easily occur in the vicinity of the first rim spout port, by providing the overhanging part of the upstream side water passage.

With these arrangements, it is possible to improve the level of performance in flushing the toilet clean while preventing the flush water from spattering to the outside of the bowl, as well as to improve the level of performance in discharging waste, from the bowl into the draining passage.

In the present invention, it is preferable to have a configuration in which the rim includes an upright wall surface formed in such a manner that the inner circumferential surface of the rim rises from a bottom to a top face of the rim, the upright wall surface including an upper upright wall surface and a lower upright wall surface forming an upper region and a lower region, respectively, of the inner circumferential surface of the rim, and in the front region of the bowl, the lower upright wall surface is formed so as to rise from a bottom up outwardly at an angle.

According to the present invention described above, in the front region of the bowl, the flush water spouted from the first rim spout port to the water passage also flows along the lower upright wall surface of the rim. The flush water in this situation has a tendency to flow in the lower region of the lower upright wall surface.

In that situation, because the lower upright wall surface provided in the front region of the bowl is formed so as to rise from the bottom up outwardly at an angle, the flush water flowing along the lower upright wall surface provided in the front region of the bowl forms a flow that spreads outwardly from the bottom up.

Consequently, it is possible to prevent the flush water flowing along the lower upright wall surface provided in the front region of the bowl from flowing downward toward the waste receiving surface due to excessive energy loss caused by coming into contact with the overhanging part. It is therefore possible to cause the flush water to whirl toward the downstream side while maintaining a high energy level.

In the present invention, it is preferable to have a configuration in which, in the front region of the bowl, the upper upright wall surface includes: a first upper upright wall surface being provided in the upper region of the inner circumferential surface of the rim and forming either the front end or a section positioned on an upstream side of the front end of the water passage provided in the front region of the bowl; and a second upper upright wall surface being provided in the upper region of the inner circumferential surface of the rim and forming the downstream side water passage provided in the front region of the bowl, the first upper upright wall surface and the second upper upright wall surface have a first inclined surface and a second inclined surface, respectively, that are each formed so as to rise from each lower end of the first upper upright wall surface and the second upper upright wall surface toward inside upwardly at an angle, the first inclined surface and the second inclined surface have, in an elevation view, a first inclination angle and a second inclination angle, respectively, that are inclined with respect to a vertical plane, and the second inclination angle of the second inclined surface of the second upper upright wall surface is set to be larger than the first inclination angle of the first inclined surface of the first upper upright wall surface.

According to the present invention described above, in the front region of the bowl, the flush water that has been spouted from the first rim spout port whirls into the downstream side water passage via the front end of the water passage, while maintaining the strength of the water current along the upstream side water passage of which the curvature radius in a plan view is relatively large.

In that situation, the curvature radius of the downstream side water passage in a plan view is set to be smaller than that of the upstream side water passage. Accordingly, in the downstream side water passage, as the flush water advances while whirling toward the downstream side, a rising flow is formed from the lower upright wall surface to reach the second upper upright wall surface that is positioned thereabove.

However, in the downstream side water passage provided in the front region of the bowl, the second inclination angle of the second inclined surface of the second upper upright wall surface is set to be larger than the first inclination angle of the first inclined surface of the first upper upright wall surface. Accordingly, the rising flow of the flush water reaching the second upper upright wall surface is directed toward the waste receiving surface positioned on the inside, along the second inclined surface.

Consequently, it is possible to cause the strong current of flush water to flow downward toward the waste receiving surface, from the downstream side water passage provided in the front region of the bowl that is positioned to the front of the waste receiving surface.

In the present invention, it is preferable to have a configuration in which the bowl surface further includes a connecting surface that connects, with a curved surface, an outer end of the shelf surface of the water passage to a lower end of the lower upright wall surface, a curvature radius of the connecting surface in an up-and-down direction in an elevation view observed in the front region of the bowl being set to be substantially constant over an entire section of the front region of the bowl along a circumferential direction.

According to the present invention described above, with regard to the connecting surface that connects, with the curved surface, the outer end of the shelf surface of the water passage provided in the front region of the bowl to the lower end of the lower upright wall surface, the curvature radius in the up-and-down direction in an elevation view is set to be substantially constant over the entire section of the front region of the bowl along the circumferential direction. It is therefore possible to prevent the flush water from splashing due to the water flow being disturbed by an uneven shape of the curved surface of the connecting surface.

At the same time, it is possible to cause the flush water spouted from the first rim spout port to whirl into the downstream side water passage from the front end of the water passage provided in the front region of the bowl, while having a high level of energy.

In the present invention, it is preferable to have a configuration in which in the front region of the bowl, a lower end of the connecting surface is positioned at substantially a same height over the entire section of the front region of the bowl along the circumferential direction.

According to the present invention described above, the lower end of the connecting surface that connects, with the curved surface, the outer end of the water passage provided in the front region of the bowl to the lower end of the lower upright wall surface is positioned at substantially the same height over the entire section of the front region of the bowl along the circumferential direction. Accordingly, it is possible to prevent the flush water from splashing due to the water flow being disturbed by unevenness in the height position of the lower end of the connecting surface.

At the same time, it is possible to cause the flush water spouted from the first rim spout port to whirl into the downstream side water passage from the front end of the water passage provided in the front region of the bowl, while having a high level of energy.

In the present invention, it is preferable to have a configuration in which a flow path vertical cross-section of the water passage which is covered by the overhanging part in the front region of the bowl is set in such a manner that a cross-sectional area of the flow path vertical cross-section is largest in a vicinity on a downstream side of the first rim spout port.

According to the present invention described above, because the flow path is in a released state in the vicinity on the downstream side of the first rim spout port, the flush water could easily splash.

However, the flow path vertical cross-section of the water passage which is taken in the vertical direction and which has the section positioned thereabove covered by the overhanging part in the front region of the bowl is set in such a manner that the cross-sectional area thereof is the largest in the vicinity on the downstream side of the first rim spout port. Accordingly, it is possible to also set the overhanging amount (the protruding amount) of the overhanging part to be large.

Consequently, it is possible to effectively prevent the flush water from splashing from the water passage in the vicinity on the downstream side of the first rim spout port.

In the present invention, it is preferable to have a configuration in which the rim includes an inner wall forming an inner edge of the first rim spout port and an outer wall forming an outer edge of the first rim spout port, the inner circumferential surface of the rim includes: a first rim inner circumferential surface forming an inner circumferential surface of the inner wall of the rim; and a second rim inner circumferential surface forming an inner circumferential surface of the outer wall of the rim and being positioned outside the first rim inner circumferential surface, and the first rim inner circumferential surface includes a lip part forming a part of a lip of the first rim spout port, the lip part being inclined from a bottom upward diagonally, from an upstream side toward a downstream side.

According to the present invention described above, the lip part of the first rim inner circumferential surface that forms a part of the lip of the first rim spout port is inclined from the bottom upward diagonally, from the upstream side toward the downstream side. Accordingly, in the front region of the bowl, it is possible to spout the flush water in a stable manner from the first rim spout port into the water passage on the downstream side, as well as to prevent the flush water from splashing.

Consequently, it is possible to realize both the stable spouting from the first rim spout port and the prevention of splashing.

When the flush toilet according to the present invention is used, it is possible to effectively prevent the flush water from splashing to the outside of the bowl and from spattering in the surroundings, as well as to improve the level of performance in flushing the toilet clean and in discharging waste.

DETAILED DESCRIPTION OF THE PREFERRED EMBODIMENTS

A flush toilet according to an embodiment of the present invention will be explained below, with reference to FIGS. 1 to 8.

Figure 1:
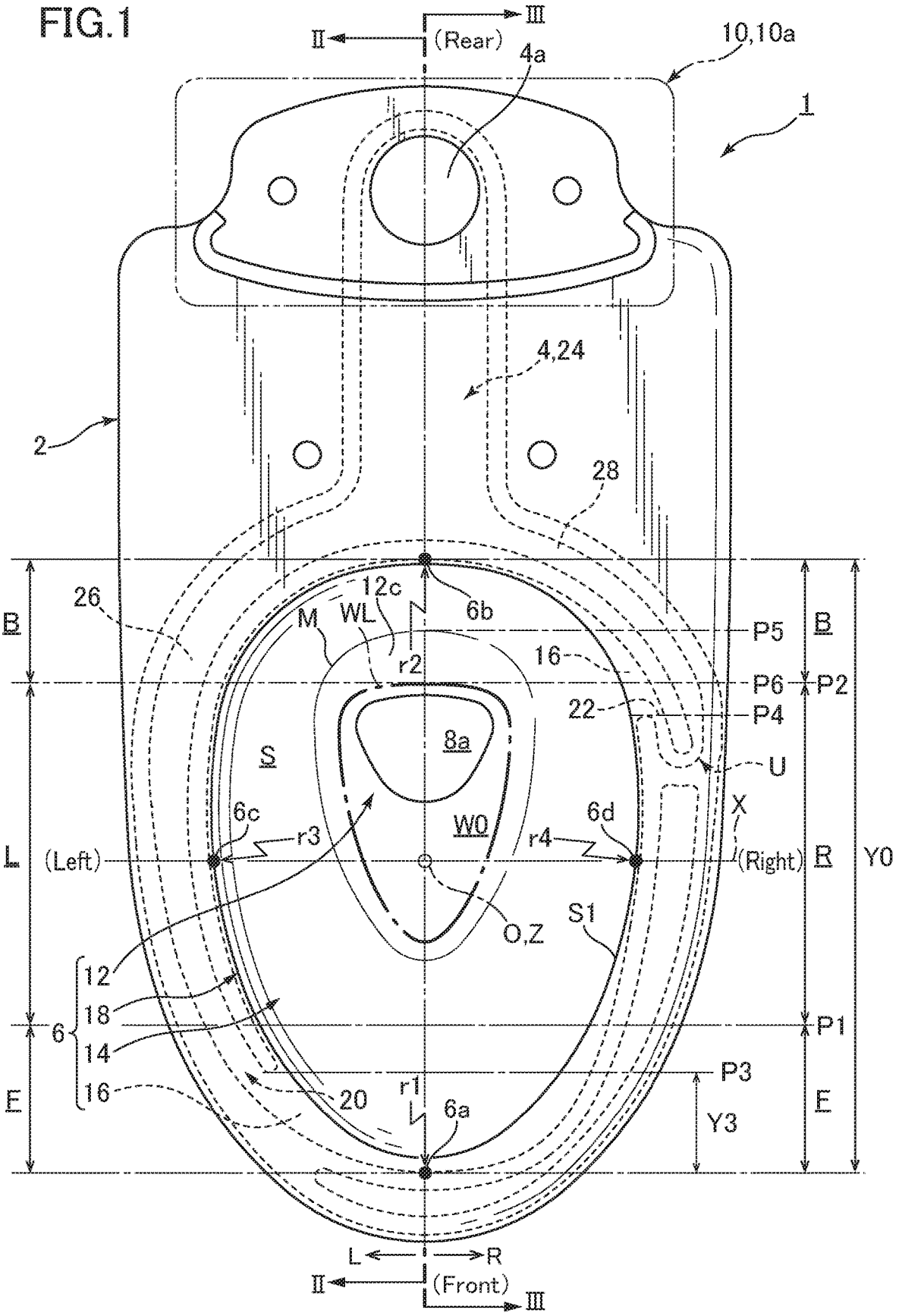
FIG. 1 is a schematic plan view of a flush toilet according to an embodiment of the present invention.

To begin with, FIG. 1 is a schematic plan view of the flush toilet according to the one embodiment of the present invention.

As illustrated in FIG. 1, a flush toilet 1 according to the one embodiment of the present invention includes a toilet main body 2 made of ceramics. The toilet main body 2 includes a water conduit 4, a bowl 6 having a bowl shape, and a drainage trap pipeline 8, arranged in the stated order from the upstream side to the downstream side.

Further, the flush toilet 1 according to the present embodiment is a so-called "flush-down flush toilet" by which waste is flushed to the drainage trap pipeline 8 with a water flow action caused by a fall in the water level of the water in the bowl 6 of the toilet main body 2.

The toilet main body 2 may be made of a material other than ceramics such as resin or the like.

On the top face of the toilet main body 2 of the flush toilet 1 according to the present embodiment illustrated in FIG. 1, a toilet seat (not illustrated) and a toilet lid (not illustrated) or the like are provided. However, because the structures of these elements are the same as those in conventional flush toilets, specific explanations thereof will be omitted.

Further, on the top face of the toilet main body 2, a sanitary washing unit (not illustrated) that washes the private part of a user and a functional unit (not illustrated) such as a water supply functional unit related to the function of supplying water to the toilet main body 2 may be provided on the rear side of the toilet seat (not illustrated) and the toilet lid (not illustrated). However, because the structures of these elements are also the same as those in conventional flush toilets, specific explanations thereof will be omitted.

As illustrated in FIG. 1, the flush toilet 1 according to the one embodiment of the present invention includes a flush water tank device 10 that is provided behind and above the bowl 6 of the toilet main body 2 and that serves as a flush water source.

Further, the flush water tank device 10 includes a water storage tank 10*a* that uses a gravity water supply method and causes the stored flush water to be suppliable to the water conduit 4 of the toilet main body 2 while making use of gravity.

In this situation, typically provided on the inside of the water storage tank 10*a* are a water supply device (not illustrated) that supplies the flush water to the inside of the water storage tank 10*a* and a water discharge valve device (not illustrated) that opens and closes a water discharge opening (not illustrated) of the water storage tank 10*a*, or the like. However, because these devices are the same as those provided in the related art, specific explanations thereof will be omitted.

In the present embodiment, the flush water source that supplies the flush water to the toilet main body 2 does not necessarily have to be of a tank type that employs, as explained above, the water storage tank 10*a* using the gravity water supply method. It is acceptable to adopt other forms of flush water sources. In other words, as the flush water source that supplies the flush water to the toilet main body 2, it is acceptable to use a tap water direct connection method that directly uses the water distribution pressure of tap water or to use a flush valve method. Alternatively, the flush water may be supplied by making use of reserve pressure of a pump.

Figure 2:
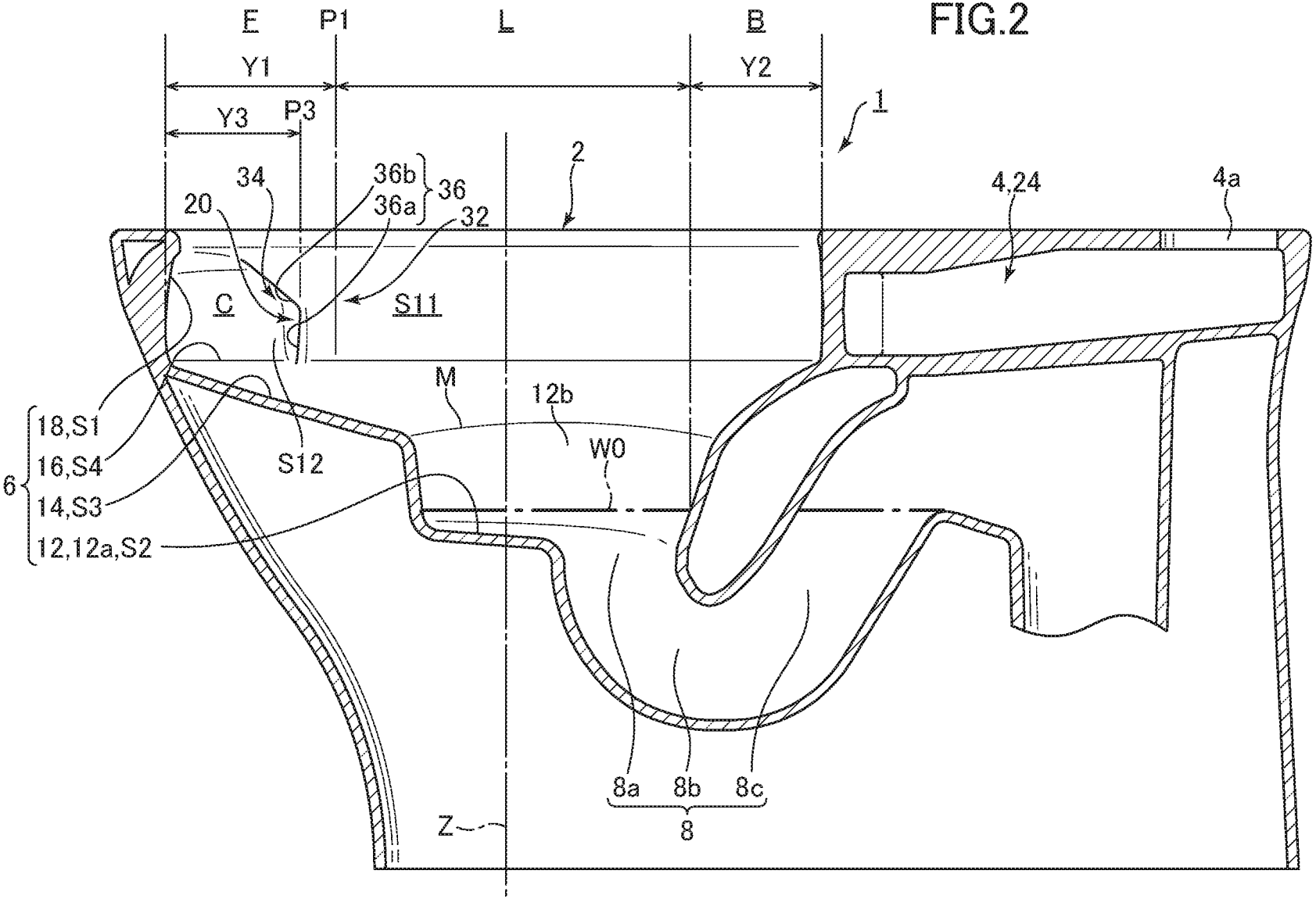
FIG. 2 is a cross-sectional view taken along the line II-II in FIG. 1.
Figure 3:
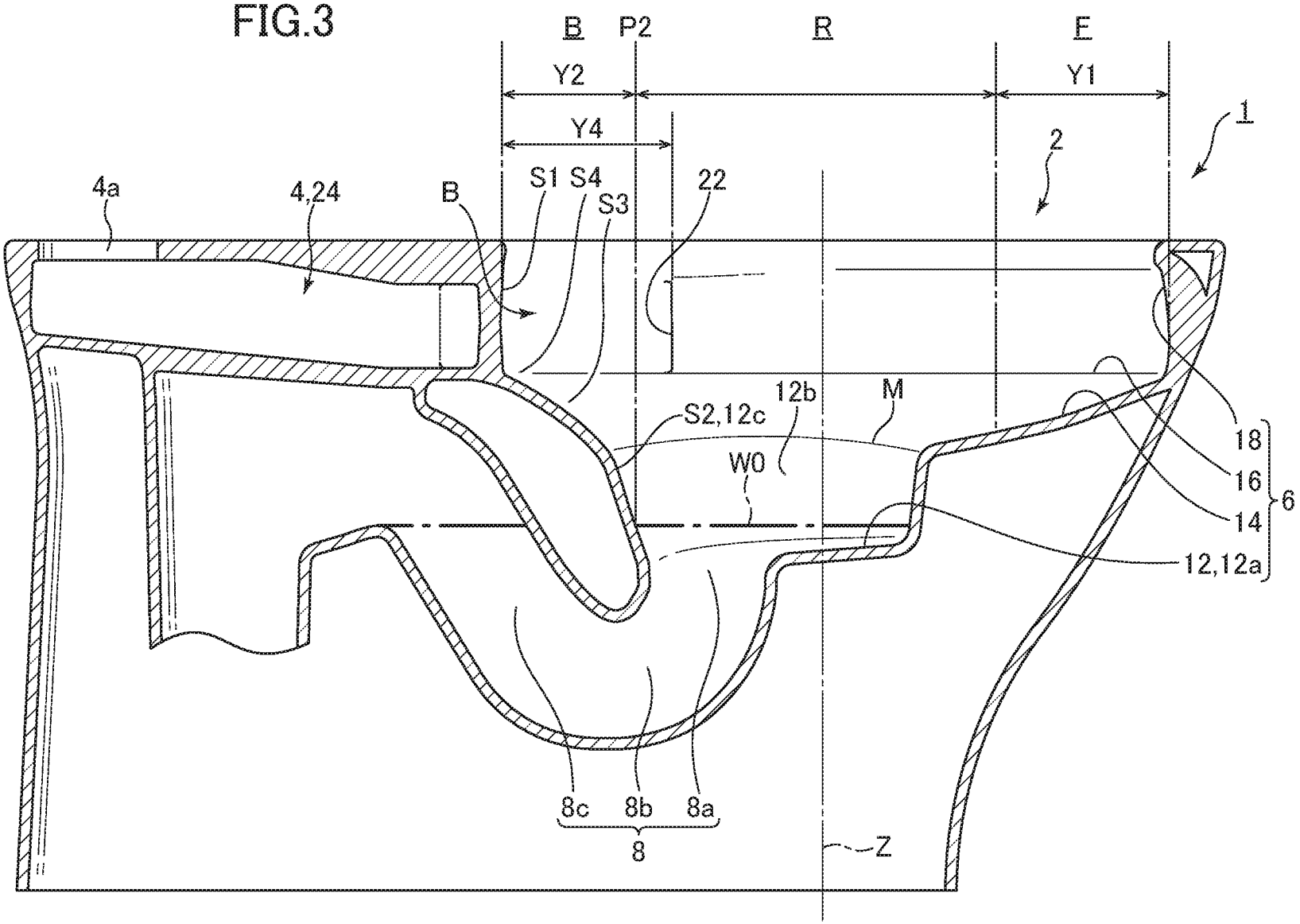
FIG. 3 is a cross-sectional view taken along the line in FIG. 1.

FIG. 2 is a cross-sectional view taken along the line II-II in FIG. 1. FIG. 3 is a cross-sectional view taken along the line in FIG. 1.

The flush water tank device 10 of the flush toilet 1 according to the present embodiment is omitted from FIGS. 2 and 3.

With regard to the flush toilet 1 according to the one embodiment of the present invention illustrated in FIG. 1, in a plan view of the bowl 6 of the toilet main body 2, the central axis line horizontally extending in the left-and-right direction as if to divide the bowl 6 into two equal sections in the front and in the rear is indicated as a line "X". The central axis line horizontally extending in the front-and-rear direction as if to divide the bowl 6 into two equal sections on the left and on the right is indicated as a line "Y".

Further, in FIG. 1, the point at which the central axis lines X and Y intersect each other is defined as the center O of the bowl 6 in a plan view. The central axis line going through the center O and extending in the vertical direction is indicated as a line "Z".

In this situation, with regard to the flush toilet 1 according to the one embodiment of the present invention illustrated in FIGS. 2 and 3, in a side view of the bowl 6 of the toilet main body 2, the central axis line extending in the vertical direction as if to divide the bowl 6 into two equal sections in the front and in the rear is indicated as the line "Z".

Further, as illustrated in FIGS. 1 to 3, the front, the rear, the left, and the right sides of the flush toilet 1 are indicated as "FRONT", "REAR", "LEFT", and "RIGHT".

Further, as illustrated in FIGS. 1 to 3, with regard to the bowl 6 of the flush toilet 1, the region from the front end (a front end 6*a* of the bowl surface S) to a boundary position P1, which is positioned toward the rear away from the front end by a prescribed distance Y1 [mm] along the central axis line Y extending horizontally in the front-and-rear direction, is defined as a "front region F of the bowl 6". The region from the rear end (a rear end 6*b* of the bowl surface S) inside the bowl 6 to a boundary position P2, which is positioned toward the front away from the rear end by a prescribed distance Y2 [mm] along the central axis line Y extending horizontally in the front-and-rear direction, is defined as a "rear region B of the bowl 6".

Further, as illustrated in FIGS. 1 to 3, with regard to the bowl 6 of the flush toilet 1, the lateral region that is positioned between the front region F and the rear region B and is positioned on the right side of the central axis line Y extending horizontally in the front-and-rear direction is defined as a "right lateral region R of the bowl 6". The other lateral region that is positioned between the front region F and the rear region B and is positioned on the left side of the central axis line Y extending horizontally in the front-and-rear direction is defined as a "left lateral region L of the bowl 6".

For example, as illustrated in FIG. 1, when the total distance in the front-and-rear direction from the front end 6*a* to the rear end 6*b* on the inside of the bowl 6 is expressed as Y0 [mm], the prescribed distance Y1 corresponding to the span of the front region F of the bowl 6 in the horizontal front-and-rear direction is set to be 30% to 40% of the total distance Y0 (Y1/Y0=0.30 to 0.40).

Further, as illustrated in FIG. 1, the prescribed distance Y2 corresponding to the span of the rear region B of the bowl 6 in the horizontal front-and-rear direction is set to be 15% to 25% of the total distance Y0 (Y2/Y0=0.15 to 0.25).

Further, as illustrated in FIGS. 1 to 3, the water conduit 4 positioned on the upstream side of the toilet main body 2 is formed on the rear side of the bowl 6 and is designed to guide the flush water supplied from the water storage tank 10*a* to the bowl 6.

Further, as illustrated in FIGS. 1 to 3, the bowl 6 positioned on the downstream side of the water conduit 4 of the toilet main body 2 includes a recessed part 12, a waste receiving surface 14, a shelf 16, and a rim 18, arranged in the stated order from the bottom upward.

The recessed part 12 of the bowl 6 is formed in the shape of a recess underneath the bowl 6 and serves as a reservoir part that contains pooled water W0.

Further, the waste receiving surface 14 of the bowl 6 is formed to have a bowl-like shape from the upper edge of the recessed part 12 and serves as a surface to receive waste.

In this situation, as illustrated in FIGS. 1 to 3, the bowl surface S curves downward from the waste receiving surface 14 to the recessed part 12. The recessed part 12 borders with the waste receiving surface 14 at the point where the downward curve starts.

In FIGS. 1 to 3, the boundary line between the waste receiving surface 14 and the recessed part 12 is indicated as "M". In other words, the boundary line M corresponds to the upper edge of the recessed part 12 and also corresponds to the inner edge and the lower edge of the waste receiving surface 14.

Further, as illustrated in FIGS. 1 to 3, the rim 18 of the bowl 6 forms the upper edge of the bowl 6. The inner circumferential surface S1 of the rim 18 is formed to have a substantially egg shape in the plan view illustrated in FIG. 1.

As illustrated in FIG. 1, in a plan view of the inner circumferential surface S1 of the rim 18 in the front region F, the rear region B, and the left and the right lateral regions L and R of the bowl 6, a representative curvature radius in the vicinity of the front end 6*a* will be referred to as r1; a representative curvature radius in the vicinity of the rear end 6*b* will be referred to as r2; a representative curvature radius in the vicinity of the left end 6*c* will be referred to as r3; and a representative curvature radius in the vicinity of the right end 6*d* will be referred to as r4, respectively.

In this situation, the curvature radius r1 is set to be smaller than the curvature radii r2, r3, and r4. Further, the curvature radii r3 and r4 are substantially equal to each other in symmetrical positions on the left and the right of the bowl 6 and are set to be larger than the curvature radius r2 ($r1<r2<r3\approx r4$).

Further, as illustrated in FIGS. 1 to 3, the shelf 16 of the bowl 6 is formed between the outer edge of the waste receiving surface 14 and the lower end of the rim 18. The flush water in the water conduit 4 is spouted after being guided to two rim spout ports (explained later), namely a first rim spout port 20 and a second rim spout port 22, and is subsequently guided along the shelf 16 to the downstream side in the circumferential direction.

Further, as illustrated in FIGS. 1 to 3, the water conduit 4 includes a shared water passage 24, a first rim water passage 26, and a second rim water passage 28.

As illustrated in FIGS. 1 to 3, the shared water passage 24 is formed on the inside of the toilet main body 2 on the rear side of the bowl 6 so as to extend from an entrance 4*a* at the rear connected to the water storage tank 10*a* to the vicinity of the rear face side of the bowl 6 at the front.

Further, as illustrated in FIG. 1, in the vicinity of the rear face side of the bowl 6, the first rim water passage 26 branches from the shared water passage 24 toward one side of the bowl 6 (toward the left side as viewed from the front of the bowl 6).

Further, as illustrated in FIG. 1, the first rim water passage 26 is formed on the inside of the rim 18 provided in the left lateral region L of the bowl 6, so as to extend to the front while detouring along the outer circumferential surface of the bowl 6, before reaching the first water spout port (the first rim spout port 20) provided in the front region F positioned to the front thereof.

Further, as illustrated in FIGS. 1 to 3, in the vicinity on the rear face side of the bowl 6, the second rim water passage 28 branches from the shared water passage 24 toward the other side of the bowl 6 (toward the right side as viewed from the front of the bowl 6).

Further, as illustrated in FIG. 1, the second rim water passage 28 is formed on the inside of the rim 18 in the rear region B of the bowl 6, so as to extend to the front while detouring along the outer circumferential surface of the bowl 6.

Further, as illustrated in FIG. 1, the second rim water passage 28 is formed to make a U-turn toward the rear side on the inside of the rim 18 positioned in the right lateral region R, in such a position that is to the front of the rear region B of the bowl 6 and to the rear of the central axis line X extending horizontally in the left-and-right direction, before reaching the second water spout port (the second rim spout port 22) provided on the rear side within the right lateral region R of the bowl 6.

Further, as illustrated in FIG. 1, the second rim water passage 28 includes an entrance 28*a*, an outer water passage 28*b*, a curved water passage 28*c*, and an inner water passage 28*d*, arranged in the stated order from the upstream side to the downstream side, to be more specific.

With these arrangements, the second rim water passage 28 forms, in a plan view, a part that turns in the shape of a U (a U-turn part U), starting with a front part (a downstream side part) of the outer water passage 28*b*, continuing as the curved water passage 28*c* and the inner water passage 28*d*, and reaching the second rim spout port 22 positioned at the downstream end thereof.

Further, as illustrated in FIGS. 1 to 3, the drainage trap pipeline 8 positioned on the downstream side of the toilet main body 2 is a draining passage which is formed from underneath the bowl 6 toward the rear and through which waste in the bowl 6 is disposed of.

Further, as illustrated in FIGS. 1 to 3, the entrance 8*a* of the drainage trap pipeline 8 is connected to a position underneath the recessed part 12 of the bowl 6.

Further, as illustrated in FIGS. 2 and 3, the drainage trap pipeline 8 includes a downward passage 8*b* that descends downward and rearward from the entrance 8*a*; and an upward passage 8*c* that ascends upward and rearward from the downstream end of the downward passage 8*b*.

Further, as illustrated in FIGS. 1 to 3, the bowl 6 includes: a wall surface S2 including a bottom wall surface 12*a* and a lateral wall surface 12*b* within the recessed part 12; an entire surface S3 of the waste receiving surface 14; the surface (the shelf surface) S4 of the shelf 16; and the inner circumferential surface S1 of the rim 18, arranged in the stated order from the bottom upward. These surfaces S1 to S4 form the bowl surface S having a bowl shape.

In the present embodiment, the bowl surface S of the bowl 6 is formed to have a substantially egg shape in a plan view. However, another arrangement is also acceptable in which the bowl surface S is formed to have a substantially oval shape that is different from the egg shape.

Further, as illustrated in FIGS. 1 and 2, the first rim spout port 20 of the flush toilet 1 is arranged in the vicinity of such a region of the bowl surface S where the left lateral region L transitions into the front region F, the left lateral region L being positioned on the one side with respect to the central axis line Y extending horizontally in the front-and-rear direction. More specifically, the first rim spout port 20 is arranged on the rear side within the front region F positioned to the front of the boundary position P1 of the front region F of the bowl 6.

For example, as illustrated in FIGS. 1 and 2, the distance Y3 in the front-and-rear direction from the front end 6*a* on the inside of the bowl 6 to the position P3 of the first rim spout port 20 provided in the front region F of the bowl 6 is set to be 15% to 35% of the total distance Y0 on the inside of the bowl 6 (Y3/Y0=0.15 to 0.35).

Further, as illustrated in FIGS. 1 and 3, the second rim spout port 22 of the flush toilet 1 is arranged in the vicinity of such a region of the bowl surface S where the right lateral region R transitions into the rear region B, the right lateral region R being positioned on the other side with respect to the central axis line Y extending horizontally in the front-and-rear direction. More specifically, the second rim spout port 22 is arranged on the rear side within the right lateral region R positioned to the front of the boundary position P2 which is on the front side of the rear region B of the bowl 6.

For example, as illustrated in FIGS. 1 and 3, the distance Y4 in the front-and-rear direction from the rear end 6*b* on the inside of the bowl 6 to the position P4 of the second rim spout port 22 provided in the right lateral region R of the bowl 6 is set to be 15% to 35% of the total distance Y0 on the inside of the bowl 6 (Y4/Y0=0.15 to 0.35).

Further, as illustrated in FIGS. 1 and 3 to 5, the position P4 of the second rim spout port 22 is arranged to the front of the rear end position P5 of the recessed part 12 of the bowl 6 (P5 being a position that also corresponds to the upper end position of the rear wall surface 12*c* on the inside of the recessed part 12 illustrated in FIG. 3). In particular, as illustrated in FIG. 1, the rear end position P5 of the recessed part 12 is positioned at the rearmost end of the boundary line M between the waste receiving surface 14 and the recessed part 12.

Further, as illustrated in FIGS. 1 to 3 and 5, the water level (a pooled water surface WL) of the pooled water W0 contained in the recessed part 12 of the bowl 6 is indicated as a still water position in a standby state before the flushing of the toilet is started and after the flushing of the toilet is completed.

Further, as illustrated in FIG. 1, the position P4 of the second rim spout port 22 is, in a plan view, positioned to the front of the rear end position P6 of the pooled water surface WL of the pooled water W0 contained in the recessed part 12 of the bowl 6.

Further, as illustrated in FIGS. 1 and 3, the opening cross-section of the second rim spout port 22 is formed as an opening directed toward the rear, in terms of the front-and-rear direction of the toilet main body 2.

Figure 4:
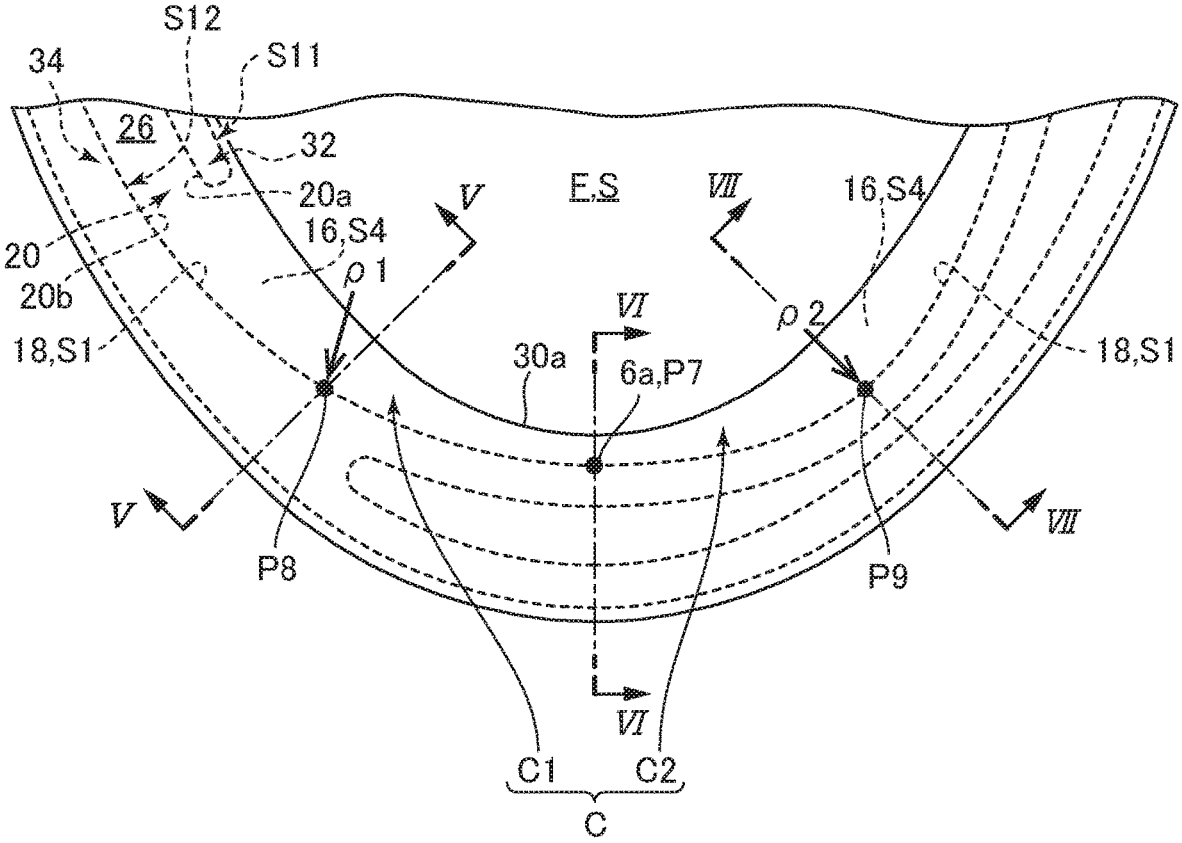
FIG. 4 is a partial enlarged plan view showing in enlargement a front region of a bowl of the flush toilet according to the one embodiment of the present invention illustrated in FIG. 1.

FIG. 4 is a partial enlarged plan view showing in enlargement the front region of the bowl of the flush toilet according to the one embodiment of the present invention illustrated in FIG. 1.

As illustrated in FIGS. 1 and 4, on the inside of the front region F of the bowl 6, a water passage C is formed by the waste receiving surface 14 and S3, the surface of the shelf 16 (the shelf surface S4), and the inner circumferential surface S1 of the rim 18.

Further, as illustrated in FIG. 4, the water passage C provided in the front region F of the bowl 6 includes an upstream side water passage C1 and a downstream side water passage C2.

Further, as illustrated in FIG. 4, the upstream side water passage C1 is formed on the downstream side to the front of the first rim spout port 20 and is formed on the left side and on the upstream side to the rear of the position P7 of the front end 6*a* of the bowl surface S.

Figure 6:
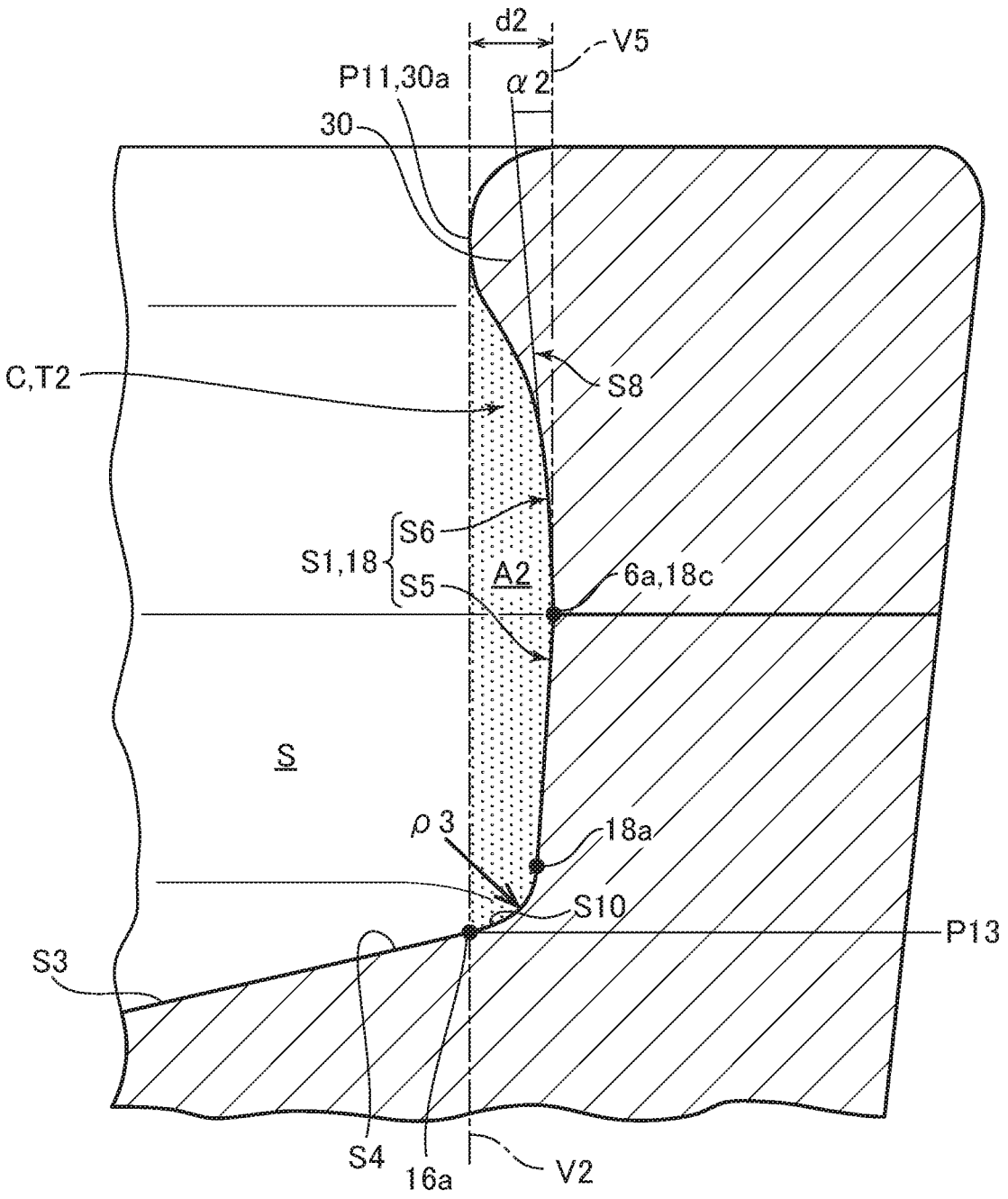
FIG. 6 is a cross-sectional view taken along the line VI-VI in FIG. 4 and showing a flow path vertical cross-section of a water passage taken in a front end, the water passage being provided in the front region of the bowl of the flush toilet according to the one embodiment of the present invention.

In contrast, as illustrated in FIGS. 1 and 6, the downstream side water passage C2 is formed on the right side and on the downstream side to the rear of the position P7 of the front end 6*a* of the bowl surface S.

Further, as illustrated in FIG. 4, with regard to the flush toilet 1 according to the present embodiment, the reference symbol ρ1 denotes the curvature radius, in a plan view, of the inner circumferential surface S1 of the rim 18 observed in the prescribed position P1 in the vicinity on the downstream side of the first rim spout port 20, provided within the upstream side water passage C1 in the front region F of the bowl 6. The reference symbol ρ2 denotes the curvature radius, in a plan view, of the inner circumferential surface S1 of the rim 18 observed in a prescribed position P8 in an intermediate part of the downstream side water passage C2. In this situation, the curvature radius ρ2 is set to be smaller than the curvature radius ρ1 (ρ2<ρ1).

Figure 5:
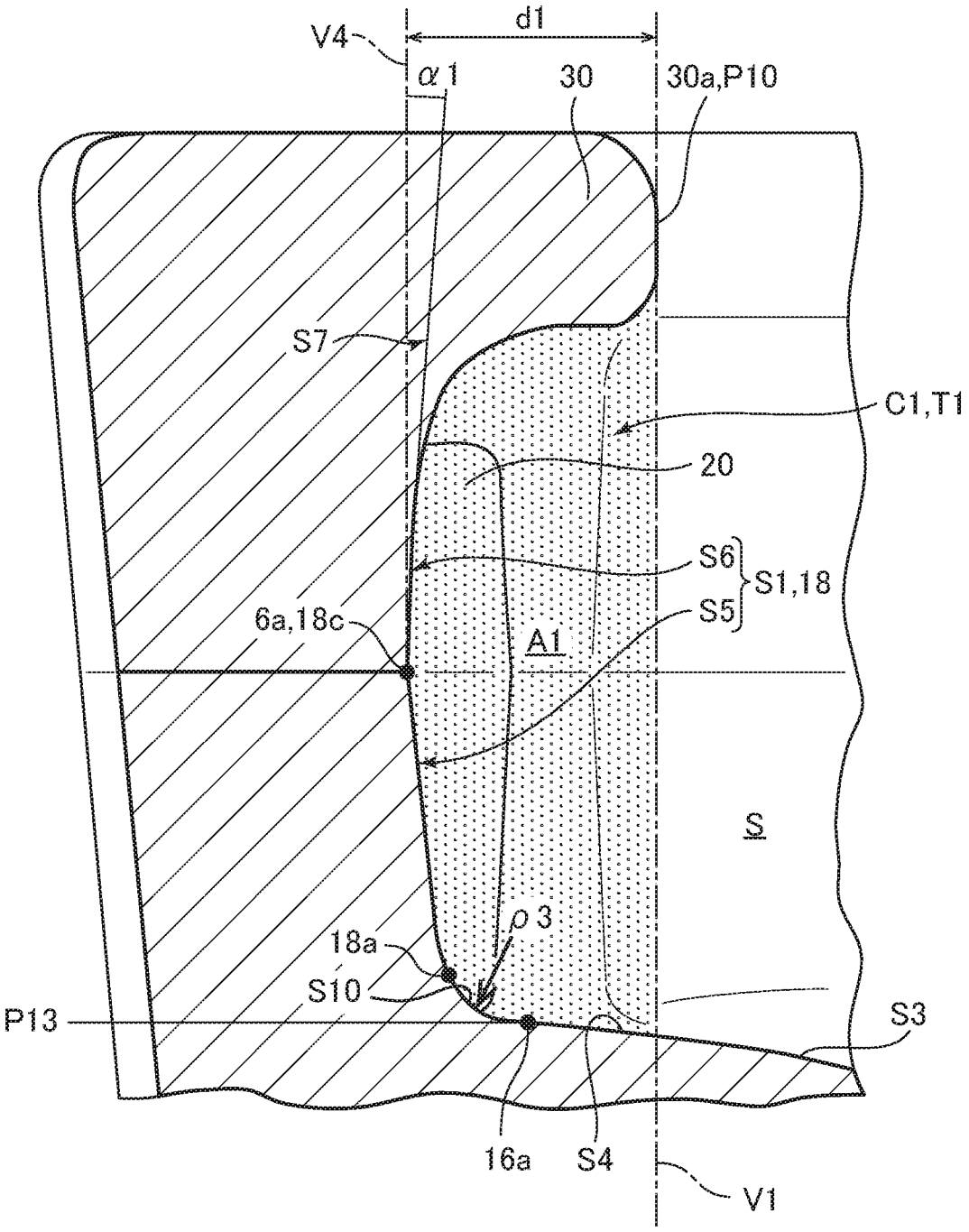
FIG. 5 is a cross-sectional view taken along the line V-V in FIG. 4 and showing a flow path vertical cross-section of an upstream side water passage taken at a prescribed position in the vicinity on the downstream side of a first rim spout port, the upstream side water passage being provided in the front region of the bowl of the flush toilet according to the one embodiment of the present invention.

FIG. 5 is a cross-sectional view taken along the line V-V in FIG. 4 and showing a flow path vertical cross-section of the upstream side water passage C1 taken at the prescribed position P8 in the vicinity on the downstream side of the first rim spout port 20, the upstream side water passage C1 being provided in the front region F of the bowl 6 of the flush toilet 1 according to the one embodiment of the present invention.

FIG. 6 is a cross-sectional view taken along the line VI-VI in FIG. 4 and showing a flow path vertical cross-section of the water passage C taken at the front end 6*a*, the water passage C being provided in the front region F of the bowl 6 of the flush toilet 1 according to the one embodiment of the present invention.

Figure 7:
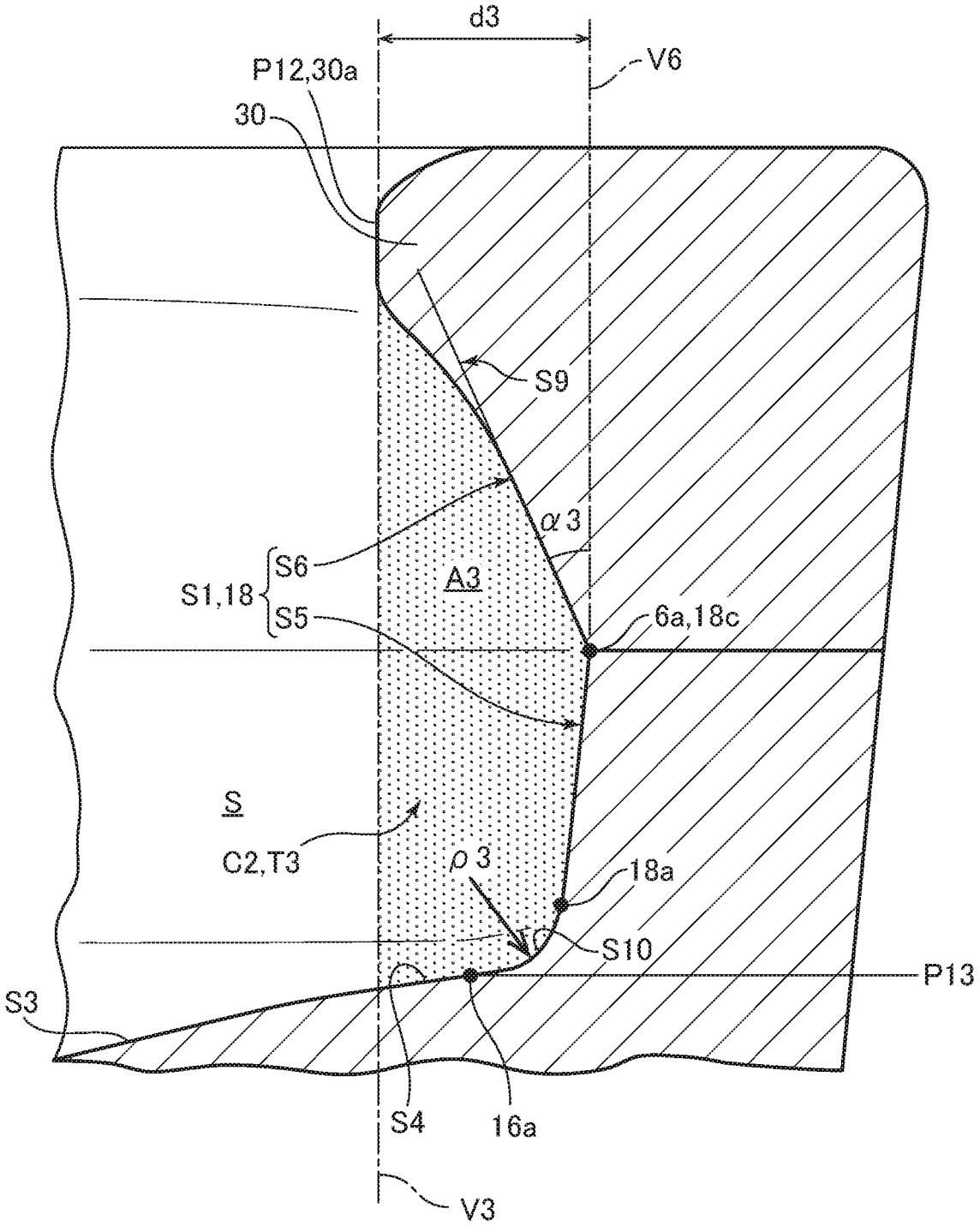
FIG. 7 is a cross-sectional view taken along the line VII-VII in FIG. 4 and showing a flow path vertical cross-section of a downstream side water passage taken at a prescribed position in an intermediate part thereof, the downstream side water passage being provided in the front region of the bowl of the flush toilet according to the one embodiment of the present invention.

FIG. 7 is a cross-sectional view taken along the line VII-VII in FIG. 4 and showing a flow path vertical cross-section of the downstream side water passage C2 taken at a prescribed position P9 in an intermediate part thereof, the downstream side water passage C2 being provided in the front region F of the bowl 6 of the flush toilet 1 according to the one embodiment of the present invention.

As illustrated in FIGS. 4 to 7, the rim 18 in the front region F of the bowl surface S includes an overhanging part 30 formed in such a manner that an upper section of the inner circumferential surface S1 of the rim 18 protrudes toward the inside of the bowl 6.

Further, as illustrated in FIGS. 4 and 5, with regard to a flow path vertical cross-section T1 taken in the vertical direction at the prescribed position P8 in the vicinity on the downstream side of the first rim spout port 20 within the upstream side water passage C1 provided in the front region F of the bowl 6, the flow path cross-sectional area shall be expressed as "A1" and is defined by a vertical plane V1 extending from positions P10 of the tip end (the innermost end 30*a*) on the innermost circumferential side of the overhanging part 30 of the rim 18 to the shelf surface S4, as well as the shelf surface S4 positioned on the outer circumferential side thereof, and the inner circumferential surface S1 of the rim 18.

Further, as illustrated in FIGS. 4 and 6, with regard to a flow path vertical cross-section T2 taken in the vertical direction at the position P8 at the front end 6*a* of the water passage C provided in the front region F of the bowl 6, the flow path cross-sectional area shall be expressed as "A2" and is defined by a vertical plane V2 extending from a position P11 of the innermost end 30*a* of the overhanging part 30 of the rim 18 to the shelf surface S4, as well as the shelf surface S4 positioned on the outer circumferential side thereof, and the inner circumferential surface S1 of the rim 18.

Further, as illustrated in FIGS. 4 and 7, with regard to a flow path vertical cross-section T3 taken in the vertical direction at the prescribed position P9 in the intermediate part of the downstream side water passage C2 provided in the front region F of the bowl 6, the flow path cross-sectional area shall be expressed as "A3" and is defined by a vertical plane V3 extending from a position P12 of the innermost end 30*a* of the overhanging part 30 of the rim 18 to the shelf surface S4, as well as the shelf surface S4 positioned on the outer circumferential side thereof, and the inner circumferential surface S1 of the rim 18.

In this situation, as illustrated in FIGS. 4 to 7, among the cross-sectional areas A1 to A3 of the flow path vertical cross-sections T1 to T3 of the water passage C provided in the front region F of the bowl 6, the cross-sectional area A2 of the flow path vertical cross-section T2 taken in the vertical direction at the front end 6*a* of the water passage C is set to be the smallest in the entire section of the water passage C along the circumferential direction.

In other words, the cross-sectional area A2 of the flow path vertical cross-section T2 taken in the vertical direction at the front end 6*a* of the water passage C illustrated in FIG. 6 is set so as to be smaller than the flow path cross-sectional area A1 of the upstream side water passage C1 illustrated in FIG. 5 and the flow path cross-sectional area A3 of the downstream side water passage C2 illustrated in FIG. 7 (A2<A1 and A2<A3).

Further, as illustrated in FIGS. 5 to 7, the flow path vertical cross-sections T1 to T3 taken in the vertical direction of the water passage C provided in the front region F of the bowl surface S are regions in which the sections positioned thereabove are covered by the overhanging part 30 of the inner circumferential surface S1 of the rim 18.

Further, as illustrated in FIGS. 5 to 7, among the flow path cross-sectional areas A1 to A3 of the flow path vertical cross-sections T1 to T3 taken in the vertical direction of the water passage C provided in the front region F of the bowl surface S, the flow path cross-sectional area A1 in the vicinity on the downstream side of the first rim spout port 20 illustrated in FIG. 5 is set to be the largest in the entire section of the water passage C along the circumferential direction (A1>A2 and A1>A3).

Incidentally, as illustrated in FIGS. 5 to 7, with regard to the overhanging part 30 of the inner circumferential surface S1 of the rim 18 observed on the flow path vertical cross-sections T1 to T3 of the water passage C provided in the front region F of the bowl 6, distances d1 to d3 in the horizontal direction from the front end 6*a* of the water passage C to the innermost ends 30*a* substantially correspond to the overhanging amounts (the protruding amounts) of the overhanging part 30.

In this situation, the overhanging amount (the protruding amount) d2 of the overhanging part 30 observed on the flow path vertical cross-section T2 at the front end 6*a* of the water passage C provided in the front region F of the bowl surface S illustrated in FIG. 6 is set to be relatively small.

In contrast, the overhanging amount (the protruding amount) d1 of the overhanging part 30 observed on the flow path vertical cross-section T1 of the upstream side water passage C1 illustrated in FIG. 5 and the overhanging amount (the protruding amount) d3 of the overhanging part 30 observed on the flow path vertical cross-section T3 of the downstream side water passage C2 illustrated in FIG. 7 are set to be larger than the overhanging amount (the protruding amount) d2 of the overhanging part 30 observed on the flow path vertical cross-section T2 at the front end 6*a* of the water passage C provided in the front region F of the bowl surface S illustrated in FIG. 6 (d1>d2 and d3>d2).

Further, as illustrated in FIGS. 5 to 7, the inner circumferential surface S1 of the rim 18 provided in the front region F of the bowl 6 serves as an upright wall surface S1 formed so as to rise from the lower end 18*a* of the rim 18 to the top face (the uppermost end face) 18*b* of the rim 18.

Further, as illustrated in FIGS. 5 to 7, the upright wall surface S1 includes a lower upright wall surface S5 and an upper upright wall surface S6 that form a lower region and an upper region, respectively, of the inner circumferential surface S1 of the rim 18.

Further, as illustrated in FIGS. 5 to 7, the lower upright wall surface S5 is formed so as to rise from the bottom up outwardly at an angle.

Further, as illustrated in FIGS. 5 to 7, the upper upright wall surfaces S6 of the flow path vertical cross-sections T1 to T3 of the water passage C provided in the front region F of the bowl 6 have inclined surfaces S7 to S9, respectively, that are each formed so as to rise from the lower end 18*c* thereof toward the inside upwardly at an angle.

Further, as illustrated in FIGS. 5 to 7, in an elevation view of the flow path vertical cross-sections T1 to T3, the inclination angles formed by the inclined surfaces S7 to S9 of the upper upright wall surfaces S6 with respect to a corresponding one of the vertical planes V4 to V6 shall be expressed as "$\alpha$1", "$\alpha$2", and "$\alpha$3", respectively.

In this situation, the inclination angle α3 of the inclined surface S9 of the upper upright wall surface S6 observed on the flow path vertical cross-section T3 of the downstream side water passage C2 illustrated in FIG. 7 is set to be larger than the inclination angle α1 of the inclined surface S7 of the upper upright wall surface S6 observed on the flow path vertical cross-section T1 of the upstream side water passage C1 illustrated in FIG. 5 (α3>α1) and is also set to be larger than the inclination angle α2 of the inclined surface S8 of the upper upright wall surface S6 observed on the flow path vertical cross-section T2 at the front end 6*a* of the water passage C1 illustrated in FIG. 6 (α3>α2).

Further, as illustrated in FIGS. 5 to 7, the front region F of the bowl surface S further includes a connecting surface S10 that connects, with a curved surface, the outer end 16*a* of the shelf surface S4 of the water passage C to the lower end 18*a* of the lower upright wall surface S5.

Further, as illustrated in FIGS. 5 to 7, in an elevation view of the flow path vertical cross-sections T1 to T3, the curvature radius ρ3 of each of the connecting surfaces S10 in an up-and-down direction in an elevation view is set to be substantially constant over the entire section of the water passage C along the circumferential direction in the front region F of the bowl surface S.

In this situation, it is preferable to set the curvature radius ρ3 of each of the connecting surfaces S10 to be in the range of 3 mm to 20 mm, and more preferably, in the range of 5 mm to 15 mm.

Further, as illustrated in FIGS. 5 to 7, in the front region F of the bowl surface S, the position P13 of the lower end 16*a* of the connecting surface S10 is arranged to be positioned at substantially the same height over the entire section of the water passage C along the circumferential direction in the front region F of the bowl surface S.

In this situation, the phrase "substantially the same" in the expression "positioned at substantially the same height" includes, naturally, the situation where the height position stays exactly the same, as well as the situation where, although the height position does not exactly stay the same, the height position varies within an error margin that can be regarded as substantially the same, in consideration of manufacturing errors of the toilet main body 2 that is made of ceramics.

Figure 8:
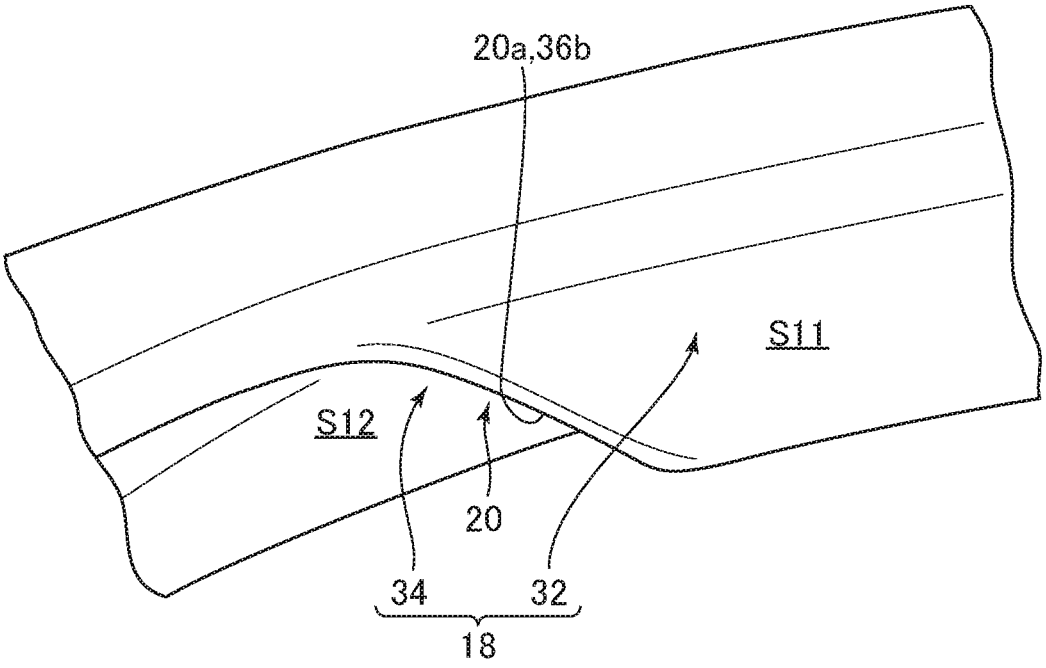
FIG. 8 is a partial enlarged perspective view showing in enlargement a part of the first rim spout port of the flush toilet according to the one embodiment of the present invention.

Further, FIG. 8 is a partial enlarged perspective view showing in enlargement a part of the first rim spout port of the flush toilet according to the one embodiment of the present invention.

As illustrated in FIGS. 2, 4, and 8, the rim 18 includes an inner wall 32 forming the inner edge 20*a* of the first rim spout port 20 and also includes an outer wall 34 forming the outer edge 20*b* of the first rim spout port 20.

Further, as illustrated in FIGS. 2, 4, and 8, the inner circumferential surface S1 of the rim 18 includes a first rim inner circumferential surface (an inner rim inner circumferential surface S11) forming the inner circumferential surface (the wall surface positioned on the waste receiving surface 14 side) of the inner wall 32 of the rim 18.

Further, as illustrated in FIGS. 2, 4, and 8, the inner circumferential surface S1 of the rim 18 includes a second rim inner circumferential surface (an outer rim inner circumferential surface S12) forming the inner circumferential surface (the wall surface positioned on the first rim water passage 26 side) of the outer wall 34 of the rim 18. The outer rim inner circumferential surface S12 is positioned outside the inner rim inner circumferential surface S11.

Further, as illustrated in FIGS. 2 and 8, the inner wall 32 of the rim 18 and the first rim inner circumferential surface (the inner rim inner circumferential surface S11) include a lip part 36 forming a part of a lip 20*a* of the first rim spout port 20 in the front end thereof.

Further, as illustrated in FIGS. 2 and 8, the inner wall 32 of the rim 18 and the lip part 36 of the inner rim inner circumferential surface S11 include a rising part 36*a* and an inclined part 36*b*.

As illustrated in FIG. 2, the rising part 36*a* of the lip part 36 of the inner wall 32 of the rim 18 is formed so as to rise from the shelf surface S4 at the lower end thereof substantially in the vertical direction.

Further, as illustrated in FIGS. 2 and 8, the inclined part 36*b* of the lip part 36 of the inner wall 32 of the rim 18 is connected, by the lower end thereof, to the upper end of the rising part 36*a*. The inclined part 36*b* is formed so as to be inclined from the bottom upward diagonally, from the upstream side toward the downstream side of the bowl 6 (from the rear side toward the front side of the bowl 6).

Next, actions of the flush toilet 1 according to the one embodiment of the present invention will be explained, with reference to FIGS. 1 to 9.

Figure 9:
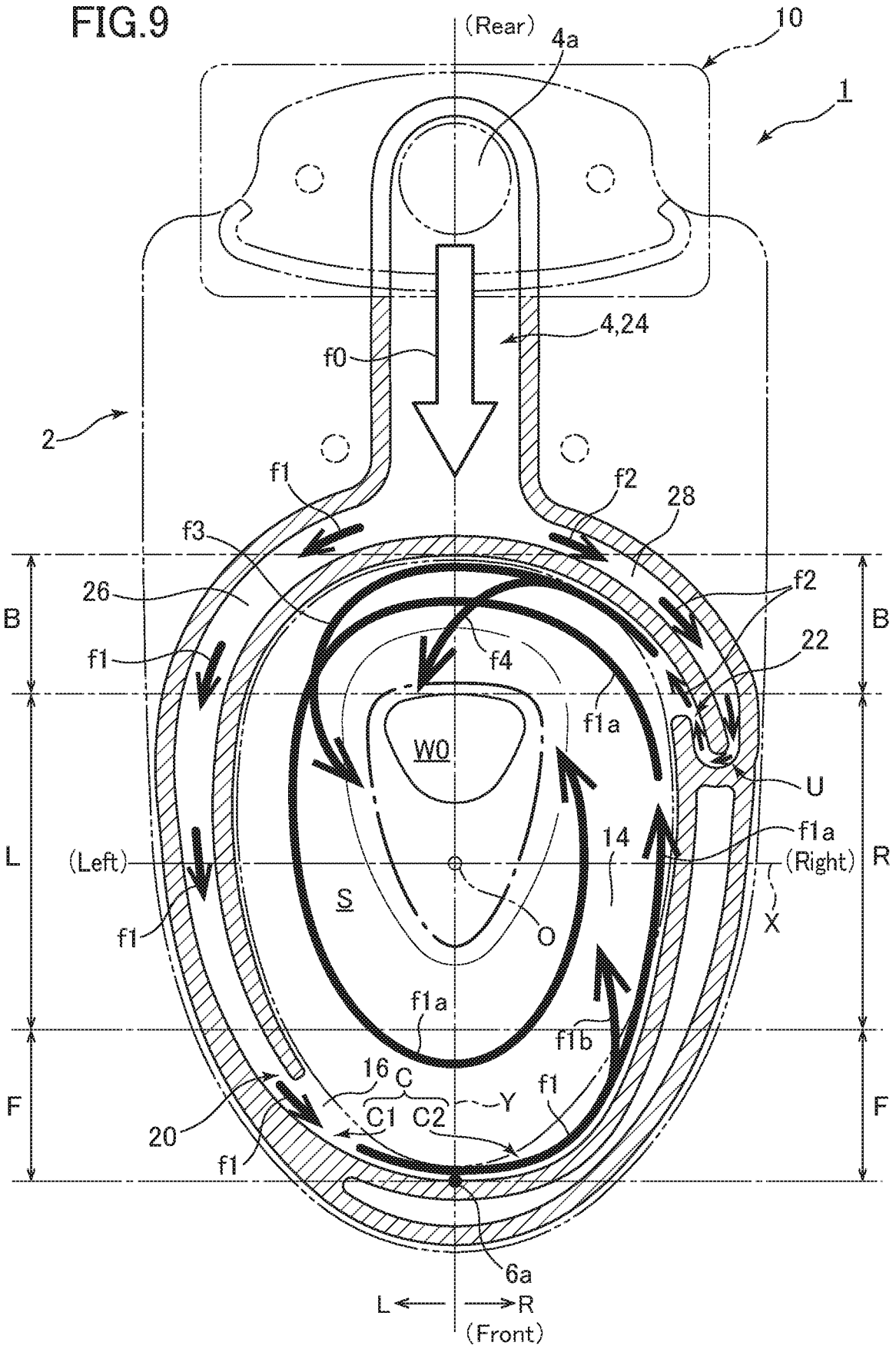
FIG. 9 is a schematic plan view for schematically explaining flows of flush water in the bowl of the flush toilet according to the one embodiment of the present invention.

FIG. 9 is a schematic plan view for schematically explaining flows of the flush water in the bowl of the flush toilet according to the one embodiment of the present invention.

Further, as illustrated in FIG. 9, when a toilet flushing process is started, the flush water in the water storage tank 10*a* is supplied to the shared water passage 24 through the entrance 4*a* of the water conduit 4 included in the toilet main body 2.

Further, the flush water (the flow f0 in FIG. 9) in the shared water passage 24 is branched into the first rim water passage 26 and the second rim water passage 28 so as to be supplied to the first rim spout port 20 and the second rim spout port 22 provided on the downstream side, respectively, before being spouted onto the downstream side in terms of the circumferential direction.

In this situation, as illustrated in FIGS. 4 to 7 and 9, in the front region F of the bowl surface S, the flush water (a flow f1) spouted from the first rim spout port 20 onto the upstream side water passage C1 in a relatively large flow volume passes through the front end 6*a* of the bowl surface S and subsequently whirls into the downstream side water passage C2.

After that, as illustrated in FIGS. 4, 7, and 9, substantially the majority of the flush water f1 in the downstream side water passage C2 whirls into the right lateral region R of the bowl surface S on the downstream side along the shelf surface S4 of the shelf 16 of the downstream side water passage C2, the connecting surface S10, the lower upright wall surface S5, and the inner circumferential surface S1 of the rim 18 and subsequently flows into the rear region B of the bowl surface S. As a result, a whirl flow f1*a* (a so-called "widthwise whirl flow") that whirls over the bowl surface S (the entire surface S3 of the waste receiving surface 14) toward the downstream side in terms of the circumferential direction is formed.

Accordingly, the flush water f1*a* (see FIG. 9) whirls over the bowl surface S (the entire surface S3 of the waste receiving surface 14 and the like) along the entire circumference so as to clean the entire area of the bowl surface S, before flowing into the recessed part 12 of the bowl 6. As a result, due to a water flow action caused by a fall in the water level of the water in the bowl 6, waste is flushed into the drainage trap pipeline 8.

Further, as the same time, as illustrated in FIGS. 4, 7, and 9, the flush water f1 in the downstream side water passage C2 provided in the front region F of the bowl 6 also forms a flow fib that flows downward from the front region F of the bowl surface S to the waste receiving surface 14 and S3, by passing through the downstream side water passage C2.

Further, at the same time, as illustrated in FIG. 9, the flush water (a flow f2) spouted from the second rim spout port 22 toward the rear flows smoothly to the downstream side along the shelf surface S4 and the inner circumferential surface S1 of the rim 18 provided in the rear region B of the bowl surface S, in the same direction as the whirling direction of the whirl flow f1, in the rear region B of the bowl surface S.

Further, as illustrated in FIG. 9, the flush water f2 within the rear region B of the bowl surface S forms a flow f3 that flushes downward toward the pooled water W0 contained in the reservoir part (the recessed part 12) provided underneath the bowl surface S, from the waste receiving surface 14 positioned on the left side of a central region of the rear region B of the bowl surface S in terms of the left-and-right direction.

Further, as illustrated in FIG. 9, a part of the flush water spouted from the second rim spout port 22 forms a flow f4 that flushes downward from the rear side toward the pooled water W0 contained in the recessed part 12 of the bowl 6, from the shelf surface S4 and the waste receiving surface 14 in the vicinity on the right side of the central region of the rear region B of the bowl surface S in terms of the left-and-right direction.

Further, as illustrated in FIG. 9, in the recessed part 12 of the bowl 6, a whirl flow (a so-called "lengthwise whirl flow") that whirls in a lengthwise direction is formed by the flows f3 and f4 of the flush water. As a result, after the pooled water W0 contained in the recessed part 12 of the bowl 6 is agitated vigorously, waste is flushed into the drainage trap pipeline 8 by a water flow action caused by a fall in the water level of the water in the recessed part 12 of the bowl 6.

When the flush toilet 1 according to the one embodiment of the present invention described above is used, as illustrated in FIG. 9, in the front region F of the bowl surface S of the bowl 6, the flush water f1 spouted from the first rim spout port 20 into the upstream side water passage C1 passes through the front end 6*a* of the bowl surface S and subsequently whirls into the downstream side water passage C2.

In that situation, as illustrated in FIGS. 5 to 7 and 9, with regard to the water passage C provided in the front region F of the bowl surface S, among the flow path vertical cross-sections T1 to T3 taken in the vertical direction which are each formed between the shelf surface S4 and the overhanging part 30 and each have the section positioned thereabove covered by the overhanging part 30 of the inner circumferential surface S1 of the rim 18, the cross-sectional area A2 of the flow path vertical cross-section T2 at the front end 6*a* of the water passage C is set to be the smallest.

With this arrangement, as illustrated in FIG. 6, it is possible to also set the overhanging amount (the protruding amount) d2 of the overhanging part 30 for the flow path vertical cross-section T2 at the front end 6*a* of the water passage C provided in the front region F of the bowl 6 to be relatively small.

In contrast, as illustrated in FIGS. 5 and 7, it is possible to set the overhanging amounts (the protruding amounts) d1 and d3 of the overhanging part 30 for the upstream side water passage C1 and the downstream side water passage C2 provided in the front region F of the bowl 6 to be larger than the overhanging amount (the protruding amount) d2 observed on the flow path vertical cross-section T2 at the front end 6*a* of the water passage C.

As a result, as illustrated in FIGS. 6 and 9, when the flush water f1 spouted from the first rim spout port 20 into the upstream side water passage C1 passes through the vicinity of the front end 6*a* of the water passage C, it is possible to prevent the energy loss that may be caused by a collision with the overhanging part 30. It is therefore possible to cause the flush water f1 to whirl into the downstream side water passage C2, while maintaining a high energy level.

Further, as illustrated in FIGS. 4, 6, 7, and 9, when the flush water f1 having passed through the vicinity of the front end 6*a* of the water passage C provided in the front region F of the bowl 6 is flowing through the downstream side water passage C2, energy loss easily occurs, because the curvature radius ρ2 of the downstream side water passage C2 in a plan view is smaller than the curvature radius ρ1 of the upstream side water passage C1 in a plan view (ρ2<ρ1), while the overhanging amount (the protruding amount) d3 of the overhanging part 30 for the flow path vertical cross-section T3 of the downstream side water passage C2 is larger than the overhanging amount (the protruding amount) d2 for the flow path vertical cross-section T2 at the front end 6*a* of the water passage C (d3>d2).

Consequently, as illustrated in FIGS. 4, 7, and 9, with regard to the flush water f1 in the downstream side water passage C2 provided in the front region F of the bowl 6, it is possible to cause the flush water f1 to flow downward from the front region F of the bowl surface S to the waste receiving surface 14 and S3 without fail and it is also possible to prevent the flush water from splashing with the use of the overhanging part 30 of the downstream side water passage C2 provided in the front region F of the bowl surface S.

Further, as illustrated in FIGS. 5 and 6, it is also possible to set the overhanging amount (the protruding amount) d1 of the overhanging part 30 of the upstream side water passage C1 provided in the front region F of the bowl 6 to be larger than the overhanging amount (the protruding amount) d2 at the front end 6*a* of the water passage C (d1>d2). Accordingly, with the use of the overhanging part 30 of the upstream side water passage C1, it is possible to prevent the flush water from splashing, which could easily occur in the vicinity of the first rim spout port 20.

With these arrangements, it is possible to improve the level of performance in flushing the toilet clean while preventing the flush water from spattering to the outside of the bowl 6. It is also possible to improve the level of performance in discharging waste, from the bowl 6 into the drainage trap pipeline 8.

Further, by using the flush toilet 1 according to the present embodiment, as illustrated in FIGS. 5 to 7 and 9, in the front region F of the bowl 6, the flush water f1 spouted from the first rim spout port 20 into the water passage C also flows along the lower upright wall surface S5 of the rim 18. However, the flush water f1 has a tendency to flow in the lower region of the lower upright wall surface S5.

In this situation, as illustrated in FIGS. 5 to 7, because the lower upright wall surface S5 of the rim 18 of the water passage C provided in the front region F of the bowl 6 is formed so as to rise from the bottom up outwardly at an angle, the flush water f1 flowing along the lower upright wall surface S5 of the water passage C forms a flow that spreads outwardly from the bottom up.

Accordingly, with regard to the flush water f1 flowing along the lower upright wall surface S5 of the rim 18 in the water passage C provided in the front region F of the bowl 6, it is possible to prevent the flush water f1 from flowing downward toward the waste receiving surface 14 due to excessive energy loss caused by coming into contact with the overhanging part 30. It is therefore possible to cause the flush water f1 to whirl to the downstream side, while maintaining a high energy level.

Further, when the flush toilet 1 according to the present embodiment is used, as illustrated in FIGS. 4 to 7 and 9, in the water passage C provided in the front region F of the bowl 6, the flush water f1 spouted from the first rim spout port 20 passes through the vicinity of the front end 6*a* of the water passage C, while maintaining the strength of the water current along the upstream side water passage C1 where the curvature radius ρ1 in a plan view is relative large, before whirling into the downstream side water passage C2.

In that situation, as illustrated in FIG. 4, because the curvature radius ρ2 of the downstream side water passage C2 in a plan view is set to be smaller than the curvature radius ρ1 of the upstream side water passage C1 in a plan view (ρ2<ρ1), a rising flow is formed in the downstream side water passage C2 illustrated in FIGS. 7 and 9, so as to rise from the lower upright wall surface S5 of the rim 18 and to reach the upper upright wall surface S6 positioned thereabove, as the flush water f1 advances whirling toward the downstream side.

However, the inclination angle α3 of the inclined surface S9 of the upper upright wall surface S6 observed on the flow path vertical cross-section T3 of the downstream side water passage C2 provided in the front region F of the bowl 6 illustrated in FIG. 7 is set to be larger than the inclination angle α1 of the inclined surface S7 of the upper upright wall surface S6 observed on the flow path vertical cross-section T1 of the upstream side water passage C1 illustrated in FIG. 5 (α3>α1) and is also set to be larger than the inclination angle α2 of the inclined surface S8 of the upper upright wall surface S6 observed on the flow path vertical cross-section T2 at the front end 6*a* of the water passage C1 illustrated in FIG. 6 (α3>α2).

With these arrangements, the rising flow of the flush water that reaches the upper upright wall surface S6 observed at the flow path vertical cross-section T3 of the downstream side water passage C2 illustrated in FIG. 7 is directed toward the waste receiving surface 14 positioned on the inside, along the inclination surface S9 of the upper upright wall surface S6.

Accordingly, as illustrated in FIGS. 4 and 9, it is possible to cause the strong current of the flush water f1 to flow downward toward the waste receiving surface 14, from the downstream side water passage C2 provided in the front region F of the bowl 6 that is positioned to the front of the waste receiving surface 14.

Further, when the flush toilet 1 according to the present embodiment is used, as illustrated in FIGS. 5 to 7, in an elevation view of the flow path vertical cross-sections T1 to T3 of the water passage C provided in the front region F of the bowl surface S, the curvature radius ρ3 of each of the connecting surfaces S10 in an up-and-down direction in an elevation view is set to be substantially constant over the entire section of the water passage C along the circumferential direction in the front region F of the bowl surface S.

With this arrangement, it is possible to prevent the flush water from splashing due to the water flow being disturbed by an uneven shape of the curved surface of the connecting surface S10.

At the same time, as illustrated in FIG. 9, as for the flush water f1 spouted from the first rim spout port 20 to the water passage C provided in the front region F of the bowl surface S, it is possible to cause the flush water f1 to whirl into the downstream side water passage C2 from the front end 6*a* of the water passage C provided in the front region F of the bowl 6, while having a high level of energy.

Further, when the flush toilet 1 according to the present embodiment is used, with regard to the connecting surface that connects, with the curved surface, the outer end of the water passage provided in the front region of the bowl to the lower end of the lower upright wall surface, the lower end of the connecting surface is positioned at substantially the same height over the entire section along the circumferential direction in the front region of the bowl. It is therefore possible to prevent the flush water from splashing due to the water flow being disturbed by unevenness in the height position of the lower end of the connecting surface.

At the same time it is possible to cause the flush water spouted from the first rim spout port to whirl into the downstream side water passage from the front end of the water passage provided in the front region of the bowl, while having a high level of energy.

Further, when the flush toilet 1 according to the present embodiment is used, because the flow path is in a released state in the vicinity on the downstream side of the first rim spout port 20, the flush water could easily splash.

However, as illustrated in FIGS. 5 to 7, with regard to the cross-sectional areas A1 to A3 of the flow path vertical cross-sections T1 to T3 taken in the vertical direction of the water passage C provided in the front region F of the bowl surface S, it is possible to set the flow path vertical cross-sectional area A1 of the flow path vertical cross-section T1 in the vicinity on the downstream side of the first rim spout port 20 illustrated in FIG. 5 to be the largest in the entire section of the water passage C along the circumferential direction (A1>A2 and A1>A3). Accordingly, it is possible to also set the overhanging amount (the protruding amount) d1 of the overhanging part 30 for the flow path vertical cross-section T1 to be the largest in the entire section of the water passage C along the circumferential direction.

Consequently, it is possible to effectively prevent the flush water from splashing in the upstream side water passage C1 in the vicinity on the downstream side of the first rim spout port 20.

Further, when the flush toilet 1 according to the present embodiment is used, as illustrated in FIGS. 2 and 8, with regard to the inclined part 36*b* of the lip part 36 of the inner wall 32 of the rim 18, the lower end of the inclined part 36*b* is connected to the upper end of the rising part 36*a*, so that the inclined part 36*b* is inclined from the bottom upward diagonally, from the upstream side toward the downstream side of the bowl 6 (from the rear side to the front side of the bowl 6).

With this arrangement, in the front region F of the bowl 6, it is possible to spout the flush water in a stable manner from the first rim spout port 20 into the upstream side water passage C1 of the water passage C on the downstream side. It is also possible to prevent the flush water from splashing.

Consequently, it is possible to realize both the stable spouting from the first rim spout port 20 and the prevention of splashing.

The flush toilet 1 according to the present embodiment described above has been explained with the example in which the present disclosure is applied to a so-called "flush-down flush toilet". However, it is possible to apply the present disclosure to other types of flush toilets besides flush-down flush toilets.

In other words, as an example of a flush toilet other than the flush-down flush toilets, it is possible to apply the present disclosure to a so-called "siphon-type flush toilet" or the like by which waste in the bowl is sucked in by using a siphon action and is at once ejected to the outside through a drainage trap pipeline.

What is claimed is:

1. A flush toilet configured to discharge waste by flushing the flush toilet with flush water supplied from a flush water source, the flush toilet comprising:

a bowl forming a bowl-shaped surface and including a rim formed on an upper edge of the bowl; a waste receiving surface, and a water passage formed between the waste receiving surface and an inner circumferential surface of the rim;

a discharge path which is connected to a lower position of the bowl and is configured to discharge waste in the bowl; and a first rim spout and a second rim spout that are provided in the rim and that form a whirl flow on the bowl surface by spouting the flush water into the water passage, wherein the first rim spout includes a first rim spout port provided at a front of a lateral region of the rim positioned on one side with respect to a central axis line of the bowl surface extending in a front-and-rear direction, the first rim spout port being configured to open forward so as to form a water flow moving toward a front end of the bowl surface by spouting the flush water into the water passage positioned to a front of the bowl, the second rim spout includes a second rim spout port provided in the rim positioned on another side with respect to the central axis line of the bowl surface extending in the front-and-rear direction, the bowl includes a front region including the first rim spout port and the bowl surface formed to a front of the first rim spout port, the water passage provided in the front region of the bowl includes an upstream side water passage and a downstream side water passage that are respectively formed on an upstream side and a downstream side of the front end of the bowl surface, respectively, a curvature radius of the downstream side water passage in a plan view being set to be smaller than a curvature radius of the upstream side water passage in a plan view, the rim provided in the front region of the bowl includes an overhanging part formed in such a manner that an upper section of the inner circumferential surface of the rim protrudes toward an inside of the bowl, and the water passage provided in the front region of the bowl has a shelf surface onto which the flush water is spouted from the first rim spout port and a flow path vertical cross-section which is formed between the shelf surface and the overhanging part so that an upper of the flow path vertical cross-section is covered by the overhanging part, a cross-sectional area of the flow path vertical cross-section in the front end of the bowl surface being smaller than a cross-sectional area of the flow path vertical cross-section in the upstream side water passage and the downstream side water passage of the water passage.

2. The flush toilet according to claim 1, wherein the rim includes an upright wall surface formed in such a manner that the inner circumferential surface of the rim rises from a bottom to a top face of the rim, the upright wall surface including an upper upright wall surface and a lower upright wall surface forming an upper region and a lower region, respectively, of the inner circumferential surface of the rim, and in the front region of the bowl, the lower upright wall surface is formed so as to rise from a bottom up outwardly at an angle.

3. The flush toilet according to claim 2, wherein in the front region of the bowl, the upper upright wall surface includes: a first upper upright wall surface being provided in the upper region of the inner circumferential surface of the rim and forming either the front end or a section positioned on an upstream side of the front end of the water passage provided in the front region of the bowl; and a second upper upright wall surface being provided in the upper region of the inner circumferential surface of the rim and forming the downstream side water passage provided in the front region of the bowl, the first upper upright wall surface and the second upper upright wall surface have a first inclined surface and a second inclined surface, respectively, that are each formed so as to rise from each lower end of the first upper upright wall surface and the second upper upright wall surface toward inside upwardly at an angle, the first inclined surface and the second inclined surface have, in an elevation view, a first inclination angle and a second inclination angle, respectively, that are inclined with respect to a vertical plane, and the second inclination angle of the second inclined surface of the second upper upright wall surface is set to be larger than the first inclination angle of the first inclined surface of the first upper upright wall surface.

4. The flush toilet according to claim 3, wherein the bowl surface further includes a connecting surface that connects, with a curved surface, an outer end of the shelf surface of the water passage to a lower end of the lower upright wall surface, a curvature radius of the connecting surface in an up-and-down direction in an elevation view observed in the front region of the bowl being set to be substantially constant over an entire section of the front region of the bowl along a circumferential direction.

5. The flush toilet according to claim 4, wherein in the front region of the bowl, a lower end of the connecting surface is positioned at substantially a same height over the entire section of the front region of the bowl along the circumferential direction.

6. The flush toilet according to claim 1, wherein a flow path vertical cross-section of the water passage which is covered by the overhanging part in the front region of the bowl is set in such a manner that a cross-sectional area of the flow path vertical cross-section is largest in a vicinity on a downstream side of the first rim spout port.

7. The flush toilet according to claim 6, wherein the rim includes an inner wall forming an inner edge of the first rim spout port and an outer wall forming an outer edge of the first rim spout port, the inner circumferential surface of the rim includes: a first rim inner circumferential surface forming an inner circumferential surface of the inner wall of the rim; and a second rim inner circumferential surface forming an inner circumferential surface of the outer wall of the rim and being positioned outside the first rim inner circumferential surface, and the first rim inner circumferential surface includes a lip part forming a part of a lip of the first rim spout port, the lip part being inclined from a bottom upward diagonally, from an upstream side toward a downstream side.

* * * * *